US005346071A

United States Patent [19]

Page et al.

[11] Patent Number: 5,346,071

[45] Date of Patent: Sep. 13, 1994

[54] TROMMEL SCREENING APPARATUS

[75] Inventors: James H. Page, Bottineau; Robert J. Page, Grand Forks, both of N. Dak.

[73] Assignee: Norkot Manufacturing Co., Inc., Bottineau, N. Dak.

[21] Appl. No.: 148,635

[22] Filed: Nov. 5, 1993

[51] Int. Cl.[5] ..... B07B 1/24

[52] U.S. Cl. ..... 209/257; 209/288; 209/420

[58] Field of Search ..... 209/257 I, 288, 413, 209/420, 683, 935

[56] References Cited

U.S. PATENT DOCUMENTS

| | | | |
|---|---|---|---|
| 3,942,644 | 3/1976 | Vissers | 209/683 |
| 4,440,637 | 4/1984 | Smit et al. | 209/257 X |
| 5,248,042 | 9/1993 | Kuhmonen | 209/288 X |

FOREIGN PATENT DOCUMENTS

| | | | |
|---|---|---|---|
| 51565 | 6/1966 | Poland | 209/288 |
| 2176423 | 12/1986 | United Kingdom | 209/420 |
| 2223963 | 4/1990 | United Kingdom | 209/420 |

OTHER PUBLICATIONS

Re-Tech, Inc. Model 720 Portable Trommel Screen advertisment.

Royer 616 MP advertisment.

Wildcat Trommel Screen Plants Model 6-160, Model RHC-6-160 ad.

RST T14 550-d Portable Trommel Screen advertisement.

Combi Screen photo brochure.

*Primary Examiner*—H. Grant Skaggs

*Assistant Examiner*—Carol L. Druzbick

*Attorney, Agent, or Firm*—Palmatier, Sjoquist & Helget

[57] ABSTRACT

The present invention is a vehicle-mounted trommel screening apparatus. A rotating trommel screen cage having an open front and a closed back is mounted on the vehicle so that the open front of the trommel screen cage is at a side of the vehicle and is adjustably tiltable about the vehicle side while the cage rotates. A conveyor is mounted below the trommel screen cage to convey material rearwardly off the end of the trailer. A push plate folds down below the trommel to assist in loading material that has been discharged from the front. Axially extending gussets within the cage provide additional lifting and tumbling action. Material is dumped into the trommel screen cage with the cage tilted back from the open end. The rotation of the cage causes a tumbling action which simultaneously breaks up larger pieces of material and screens smaller material to the conveyor below the screen. Material retained in the trommel screen may be dumped by tilting the trommel screen cage forward toward the open end. Alternatively, as sufficient material is received in the cage larger pieces of the material will automatically fall out of the open front. The tilt angle and rotation speed may be instantaneously and variably adjusted for optimal operational.

21 Claims, 3 Drawing Sheets

TROMMEL SCREENING APPARATUS

BACKGROUND OF THE INVENTION

This invention relates to material screening apparatus. More particularly, it relates to a variably tilting trommel screening apparatus.

Screens are utilized for sorting material by size in various industries including construction, waste disposal, landscaping, and building demolition. Some such screens are substantially planar and screen by oscillating or shaking. Alternately, trommel screens are cylindrical in shape, open at both ends, and rotate. Conventional trommel screens are operated tilted at an angle from horizontal. The material to be processed is dumped into the higher end and the rotation causes the material to tumble toward the lower end with some of the material falling down through the screen and the balance discharged out the lower end. The trommel screens typically have an axial length of two or more diameters and are thus quite bulky in size and must be transported lengthwise on trailers. Trommel screens are typically configured to require an input conveyor, an exit conveyor for material that has passed all the way through the trommel and an additional conveyor to convey screened material out from under the trommel. The size and necessary ancillary equipment require an involved process in setting up the apparatus and make these trommels inconvenient or impractical for many applications. A further disadvantage is that material processed in conventional trommel screens has a limited retention time within the trommel. This has two undesirable effects: First, the material to be processed may circulate through the entire axial length of the trommel without being fully processed. That is, material that should have fallen through the screen does not and is dumped out the discharge end of the screen. Secondly, the limited retention time allows only a very limited effect of breaking up the material that is being processed. Additionally, conventional trommel screens open at both ends and have minimal or no flexibility for varying the rotation speed and tilt angle.

SUMMARY OF THE INVENTION

The present invention is a vehicle-mounted trommel screening apparatus. A rotating trommel screen cage having an open front and a closed back is mounted on the vehicle so that the open front of the trommel screen cage is at a side of the vehicle and is adjustably tiltable about the vehicle side while the cage rotates. A conveyor is mounted below the trommel screen cage to convey material rearwardly off the end of the trailer. A push plate folds down below the trommel to assist in loading material that has been discharged from the front. Axially extending gussets within the cage provide additional lifting and tumbling action. Material is dumped into the trommel screen cage with the cage tilted back from the open end. The rotation of the cage causes a tumbling action which simultaneously breaks up larger pieces of material and screens smaller material to the conveyor below the screen. Material retained in the trommel screen may be dumped by tilting the trommel screen cage forward toward the open end. Alternatively, as sufficient material is received in the cage larger pieces of the material will automatically fall out of the open front. The tilt angle and rotation speed may be instantaneously and variably adjusted for optimal operational.

An advantage and feature of the invention is that the apparatus is self-contained and may be set up and operational from a transport mode with minimal effort. An additional advantage and feature of the present invention is that the space occupied by the apparatus is significantly less than conventional trommel type screens.

An additional advantage and feature of the present invention is that a greater tumbling action is created than conventional trommel screens allowing more material to be broken up by the tumbling action.

An additional advantage and feature of the present invention is that the retention time of material within the trommel screen cage may be selectively controlled providing improved efficiency in screening.

An additional advantage and feature of the invention is that oversized material automatically falls out of the open front of the trommel screen cage while operating.

An additional advantage and feature of the invention is that the tilt of the trommel screen cage and the rotation speed may be instantaneously and variably adjusted while the trommel screen cage is operating based on the material then in the cage.

DETAILED DESCRIPTION OF THE PREFERRED EMBODIMENTS

Figure 1:
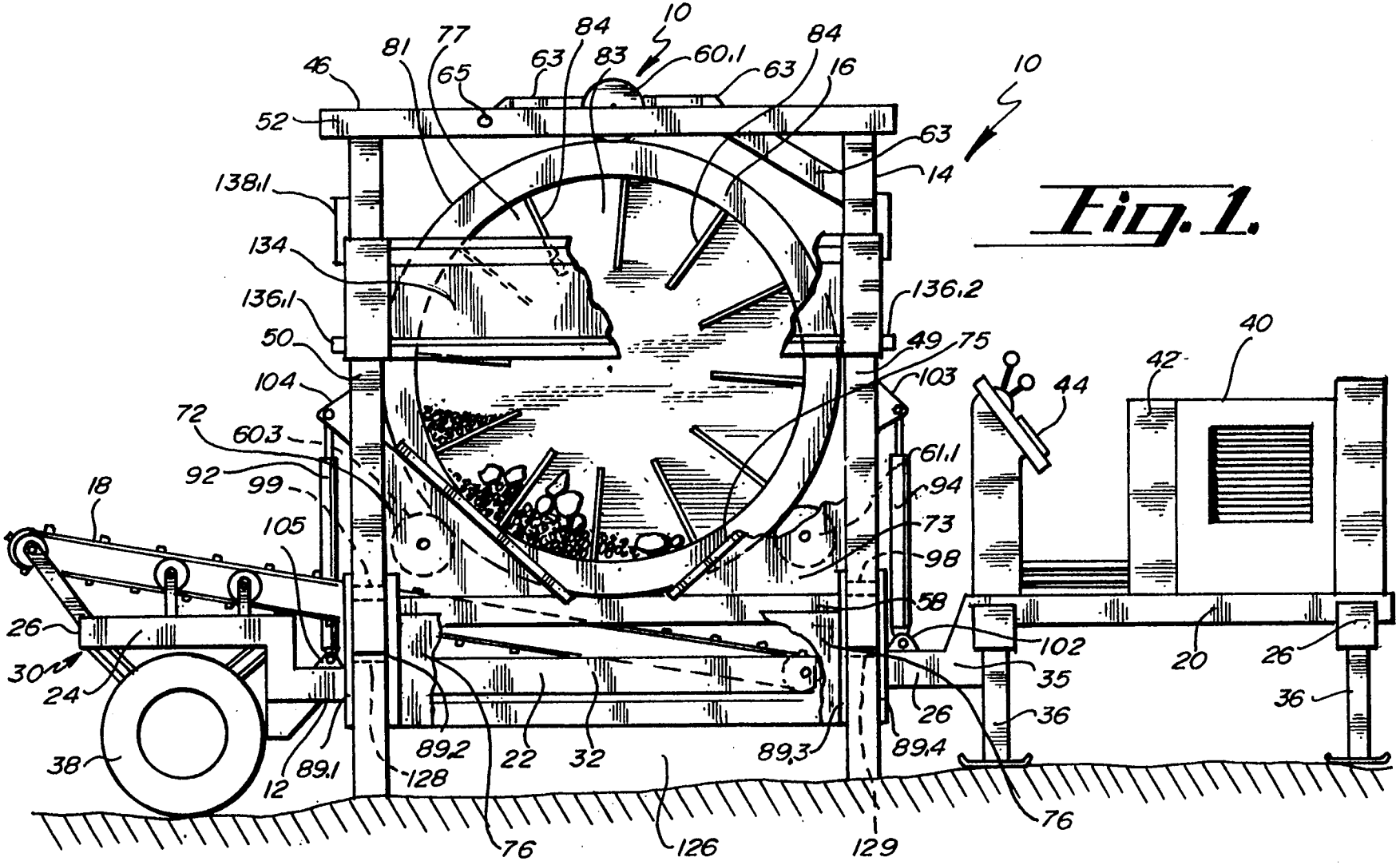
FIG. 1 is a side elevational view of the apparatus.

Referring to FIG. 1, a side elevational view of an embodiment of the trommel screening apparatus is shown and is generally indicated by the numeral 10. The principal components of the apparatus consist of the vehicle 12 which is depicted as a trailer, a carriage 14, a trommel screen cage 16, and a discharge conveyor 18.

The vehicle or trailer 12 is shown with a front portion 20, a mid-portion 22, and a rear portion 24, an outer perimeter 26, a back end 30, a first side 32, a second side 34 and a support frame 35. The trailer has four jacks 36 located in the front portion 20 of the trailer 12 that are utilized for leveling. Wheels 38 are located under the rear portion 24 of the trailer 12. Six inch by eight inch heavy wall steel tubing is suitable for construction of the frame 35.

A motor 40 and hydraulic pump 42 are shown positioned on the front portion 20 of the trailer 12. Hydraulic lines 43 connect to a control panel 44 with appropriate controls also located on the front portion 20.

Figure 2:
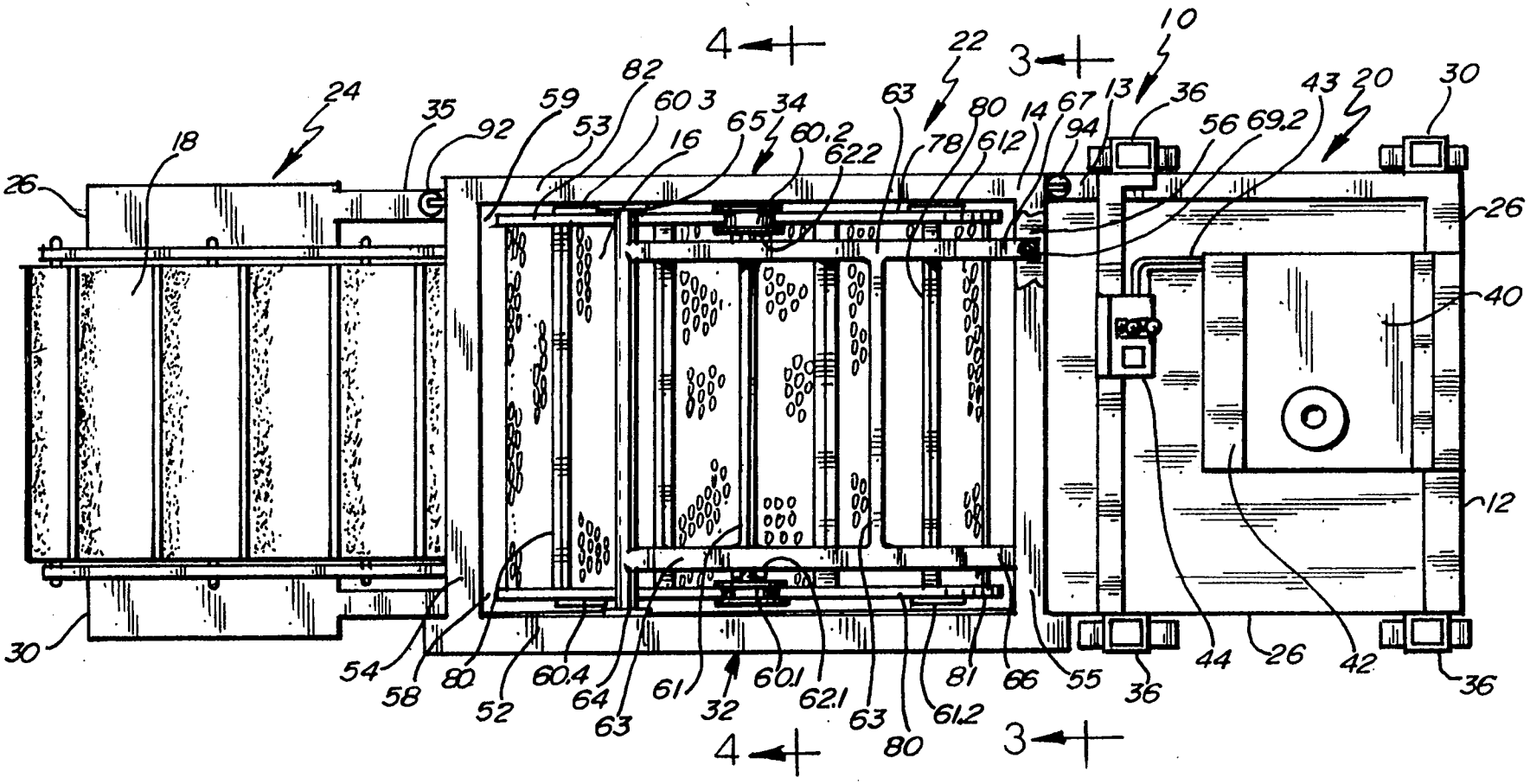
FIG. 2 is a plan view of the apparatus.
Figure 4:
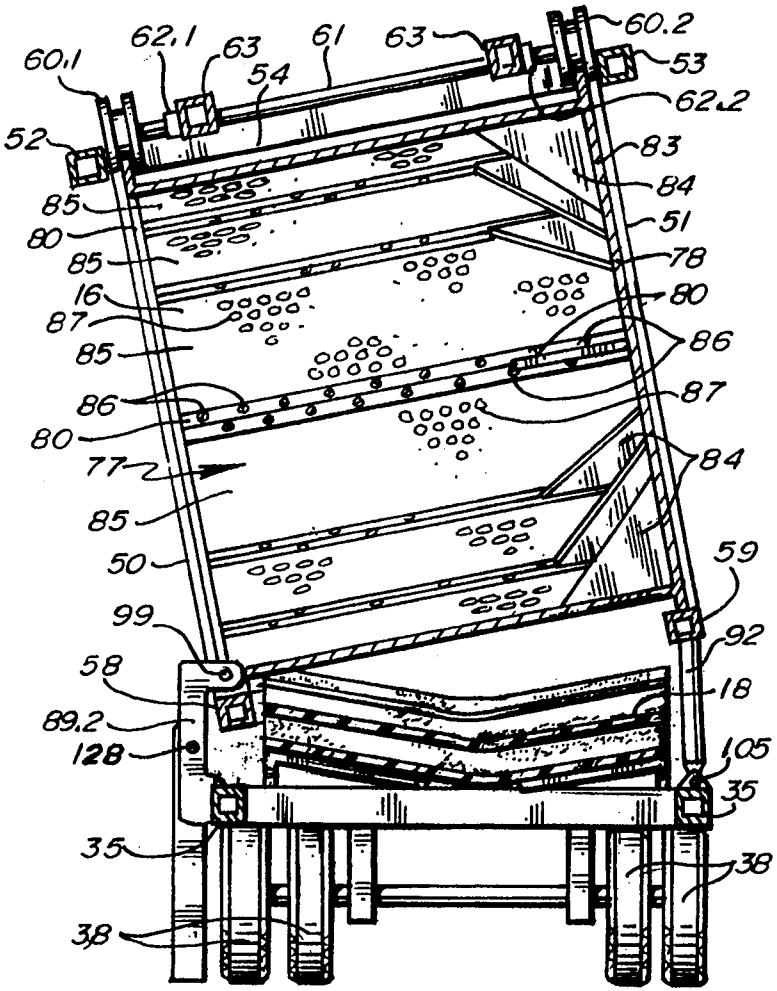
FIG. 4 is a sectional taken at plane 4—4 of FIG. 2 showing the interior of the trommel screen cage and with the carriage and trommel screen cage tilted away from the first side.
Figure 3:
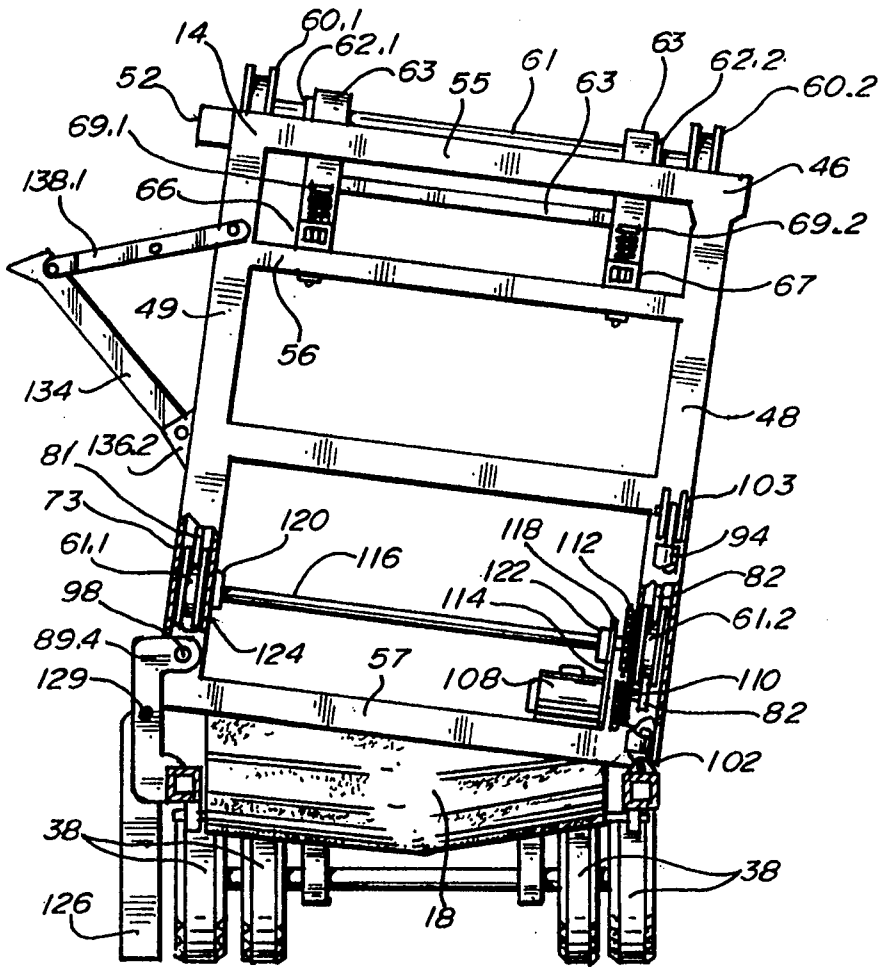
FIG. 3 is a sectional taken at plane 3—3 of FIG. 2 with the carriage and trommel screen cage tilted towards the fist side of the vehicle.

FIGS. 1 and 2 show the carriage 14 in a substantially horizontal position with respect to the support frame 35. FIG. 3 shows the carriage 14 tilted rearward away from the first side 32 and FIG. 4 shows the carriage tilted forward toward the first side 32.

Referring to FIGS. 1, 2, 3 and 4, the carriage 14 is shown. The carriage 14 supports the trommel screen cage 16 and is comprised of a rectangular framework 46 with four upright frame members 48, 49, 50, 51, four top members including a front top member 52, a rear top member 53, two upper crossing members 54, 55, a supplemental crossing member 56, a lower crossing member 57, and two lower members 58, 59. The carriage 14 supports four guide trunnions 60.1, 60.2, 60.3, 60.4 and two drive trunnions 61.1, 61.2 which guide and provide the drive for rotating the trommel screen cage 16. Six inch by six inch steel tubing is suitable for construction of the rectangular framework 46.

Referring to FIG. 2, the two uppermost guide trunnions 60.1, 60.2, ride on a common axle 61. The axle 61 is mounted by way of bearing blocks 62.1, 62.2 to a suspension frame 63 which is pivotally mounted to the upper front member 52 and the upper rear member 53 at pivot connections 64, 65. The suspension framework 63 has two distal ends 66, 67 which are attached to the supplemental cross member 56 by way of spring loaded pin connections 69.1, 69.2 as depicted in FIG. 3 and the cut away portion of FIG. 1.

Referring to FIGS. 1 and 2, triangular panels 72, 73 are shown covering two of the trunnions 60.3, 61.1. The right triangular panel 73 is shown partially cut away to reveal the drive trunnion 61.1. The panels may be removably mounted by screws or other suitable means to the rectangular framework 46 allowing access to the trunnions 60.3, 61.1. Wipers 74, 75 are mounted to the triangular panels 72, 73 and wipe the trommel screen cage to protect the trunnions 60.3, 61.1 and associated apparatus from debris. An apron 76, shown mostly cut away, is attached to the lower member 58 by screws or other suitable means, and assists in keeping material from falling through the first side under lower member 58. The wipers 74, 75 and apron 76 may be made of hard rubber or other resilient durable materials.

The trommel screen cage 16 shown in FIGS. 1, 2, and 4 and in cross section in FIG. 4 has an open front 77, a closed back 78, an outer peripheral framework 80 including two rails 81, 82, and plates or gussets 84, the closed back 78 is formed from a back plate 83 welded or otherwise suitably connected to the peripheral framework 80. The gussets 84 are formed from triangular plates and are fixed by welding or other suitable means to the back plate 83 and to the peripheral framework 80. Removable screen panels 85 are attached to the peripheral framework 80 by screws 86. The screen panels 85 have apertures 87 which are appropriately sized for the material to be screened. The rails 81, 82 are engaged by and confined within the six trunnions 60.1, 60.2, 60.3, 60.4, 61.1. 61.2 whereby, when the carriage 14 is tilted, the trommel screen cage 16 also tilts.

Referring to FIGS. 1, 3, and 4, a tilting means for variably tilting the carriage 14 and the trommel screen cage 16 is shown and is comprised principally of two hydraulic cylinders 92, 94 and four vertical hinge plates 89.1, 89.2, 89.3, 89.4 which are welded or otherwise suitably attached to the vehicle frame 13 at the mid-portion 22. The hinge plates 89.1, 89.2, 89.3, 89.4 have pins 98, 99 which extend through the upright frame members 48, 49 of the carriage 14 located on the first side 32 of the vehicle 12 thus tiltably connecting the carriage 14 to the vehicle frame 13. The hydraulic cylinders 92, 94 are attached to the frame 13 of the vehicle at the second side 34 and the two upright frame members 48, 51 of the second side 34 of the vehicle 12 by way of brackets 102, 103, 104, 105. Hydraulic lines, not shown, connect the hydraulic cylinders 92, 94 to the control panel. A tilting range of 20° rearward and 20° forward with respect to the first side of the vehicle has been determined to be appropriate.

Referring to FIGS. 1 and 3, a drive means for rotating the trommel screen cage 16 is shown. Except for the rails 81, 82 the trommel screen cage is omitted from FIG. 3. The drive means is comprised principally of a hydraulic motor 108, a drive sprocket 110, a driven sprocket 112, a chain 114, a drive shaft 116, and the two drive trunnions 61.1, 61.2. The hydraulic motor 108 is conventional and is connected via hydraulic lines, not shown, to the control panel 44 which is connected to the hydraulic pump 42. The hydraulic motor 108 is mounted on a mounting plate 118 which is welded or otherwise secured to the carriage 14. The drive shaft 116 is mounted by way of bearing blocks 120, 122 to mounting plate 118 and an additional mounting plate 124 which is opposite to the triangular shield 73 with respect to the upright frame member 49. Mounting plate 124 is welded or otherwise suitably attached to upright frame member 49 and lower member 58. Attached to the ends of the drive shaft 116 are the drive trunnions 61.1, 61.2 which are engaged by the drive rails 81, 82 of the trommel screen cage 16. An adjustable control valve, not shown, at the control panel 44 provides a variable speed range for the rotation of the trommel screen cage 16.

Referring still to FIGS. 1 and 3, a push plate 126 is hinged to the hinge plates 89.1, 89.2, 89.3, 89.4 by way of pins 128, 129. The push plate 126 swings upwardly to a substantially vertical position and may be locked in said position for transporting by appropriate means such as removable pins, not shown, extending through the hinge plates 86, 87, 88, 89 into the push plate 126.

Referring to FIGS. 1 and 3, a feed hopper 134 is attached to the carriage framework 46 by way of brackets 136.1, 136.2 and extension arms 138.1, 138.2. The feed hopper 134 may be folded in an upright position for transport or may be removed when not needed.

The conveyor, shown in all four figures, is conventional and is mounted to the support frame by appropriate and conventional means. The conveyor 18 operates by way of a hydraulic motor, not shown, which is connected to the control panel 44. The conveyor may be of a trough type as depicted in FIGS. 3 and 4.

The trommel screening apparatus 10 operates as follows. Typically for transportation the carriage 14 will be at a substantially horizontal position with respect to the vehicle frame 13, the feed hopper 134 will be in an upright folded position and the push plate 126 will also be folded upright. The vehicle 12 is moved into an appropriate position and the jacks 36 are lowered and appropriately positioned to level the apparatus. The motor 40 is started to operate the hydraulic pump 42. The push plate 126 is lowered to the position shown in FIGS. 1, 3, and 4, and the feed hopper 134 is extended to the position as shown best in FIG. 3. With a screen size appropriate for the application, the carriage 14 and consequently the trommel screen cage 16 are tilted rearwardly with respect to the first side 32 by operating the hydraulic cylinders 92, 94 by way of the control panel 44. The conveyor 18 is started and rotates in a counterclockwise direction with reference to FIG. 1. An appropriate rotation speed is selected for the trommel screen cage 16 at the control panel and material to be screened is loaded into the trommel screen cage 16 by dumping into the feed hopper 134. The angle of tilt of the carriage 14 and trommel screen cage 16 may be adjusted to prevent the material from falling forward out of the open front 77 of the trommel screen cage 16. The rotation of the screen cage 16, which is in a clockwise manner as viewed from FIG. 1, causes the material to be churned and tumbled inside of the screen cage 16 assisted by the triangular gussets 84. Material smaller than the apertures in the screen fall downwardly onto the discharge conveyor 18 which carries the screened material rearwardly to discharge it off of the end of the vehicle.

The gussets 84 in the trommel screen cage 16 operate to carry the material farther vertically than would otherwise occur to allow more of a vertical drop and therefore more breakage of the material being churned.

As material builds up inside of the trommel screen cage 16, the larger material which cannot fall through the apertures in the screen tends to fall on the top of the material tumbling inside and is the first material to fall forwardly out of the open front 77. This action can occur without any adjustment of the angle of tilt by the operator. Alternately the operator may observe the tumbling action and determine it is appropriate to dump some, or all, of the material in the screen cage 16. The operator then operates, through the control panel or otherwise, to tilt the carriage 14 and trommel screen cage 16 forwardly off of the first side 32 of the vehicle 12 to deposit the material in front of the push plate. The material may then be removed by way of a front end loader or an ancillary conveyor.

Significantly, the rotation speed and tilt of trommel screen cage 16 may be variably and instantly adjusted for optimal operation of the apparatus.

Other configurations of the apparatus are possible and anticipated such as attaching a conveyor directly below the open front to convey the larger material away from the apparatus for further processing. Additionally, the apparatus may be operated without the feed hopper by loading material directly within the trommel screen cage by way of appropriately sized equipment. Additionally, the apparatus may be operated in a moving mode to deposit the material which is discharged off of the back of the vehicle in rows.

The control panel 44 may also have remote control means such as conventional radio control equipment so that the individual operating the loading equipment may be able to instantaneously control the apparatus and to instantaneously adjust the tilt angle or the rotation speed of the trommel screen cage 16 for optimal screening effect or to dump the material or a portion of the material contained within the trommel screen cage.

In addition to being vehicle mounted, the apparatus may be otherwise mounted on similar support frames.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A trommel screening apparatus for screening material comprising:

a) a support frame;

b) a trommel screen cage for receiving material to be screened, the screen cage having an open front, a closed back, and outer peripheral framework and a screen panel attached to the peripheral framework;

c) a carriage, the screen cage rotatably mounted to the carriage, the carriage tiltably mounted to the support frame whereby the screen cage with the open front is positionable to receive and screen material and to dump unscreened material out of the apparatus;

d) a variably tilting means for tilting the carriage and screen cage; and e) a drive means engaged with the trommel screen cage for rotating the screen cage whereby the material in the screen cage is tumbled and the screened material falls downwardly through and below the screen panel.

2. The apparatus of claim 1, wherein the support frame has wheels to transport the apparatus.

3. The apparatus of claim 1 further comprising a conveyor attached to the support frame extending under the screen cage for receiving screened material from the screen cage and conveying the material out from under the screen cage.

4. The apparatus of claim 1 further comprising a plurality of trunnions mounted on the carriage and wherein the outer peripheral framework of the screen cage includes a circular rail engaged with the trunnions.

5. The apparatus of claim 4, wherein the drive means comprises a drive trunnion engaged with the rail and a hydraulic motor connected to the drive wheel.

6. The apparatus of claim 1, wherein the tilting means comprises a hinge pivotally connecting the carriage to the support frame and a hydraulic expandable cylinder opposing the hinge connecting the carriage to the support frame.

7. The apparatus of claim 6 further comprising a push plate hinged to the support frame below the open front.

8. The apparatus of claim 1, wherein the trommel screen cage further comprises a plurality of triangular gussets extending radially inward from the closed back to the peripheral framework.

9. The apparatus of claim 1 further comprising a feed hopper attached to the carriage whereby material dumped into the feed hopper is directed into the trommel screen cage.

10. A trommel screening apparatus for screening material comprising:

a) a vehicle support frame:

b) a trommel screen cage for receiving material to be screened, the screen cage having an open front, an outer peripheral framework, and a screen panel attached to the peripheral framework;

c) a carriage tiltably mounted to the vehicle support frame with the trommel screen cage rotatably mounted within the carriage whereby the screen cage with the open front is positionable to receive and screen material and to dump unscreened material out of the apparatus;

d) a hydraulic cylinder mounted between the carriage and the support frame to variably tilt the carriage and the trommel screen cage with respect to the vehicle frame;

e) a drive means attached to the carriage and engaged with the trommel screen cage for rotating the screen cage whereby the material in the screen cage is tumbled and the screened material falls downwardly through and below the screen cage; and f) a plurality of plates extending radially inward from the peripheral framework whereby the plates assist in the tumbling of the material in the trommel screen cage.

11. The apparatus of claim 10 further comprising a conveyor attached to the support frame extending under the screen cage for receiving screened material from the screen cage and conveying the material out from under the screen cage.

12. The apparatus of claim 11, wherein the trommel screen cage has a closed back and wherein the plates are also attached to the closed back.

13. The apparatus of claim 12 further comprising a plurality of trunnions mounted on the carriage, wherein the outer peripheral framework of the screen cage includes a circular rail, and wherein the circular rail is engaged with the trunnions.

14. The apparatus of claim 13, wherein the drive means comprises a drive trunnion engaged with the rail and a hydraulic motor connected to the drive trunnion.

15. The apparatus of claim 14, further comprising a hinge pivotally connecting the carriage to the support frame.

16. The apparatus of claim 15 further comprising a push plate hinged to the vehicle support frame below the open front.

17. The apparatus of claim 16 further comprising a feed hopper attached to the carriage whereby material dumped into the feed hopper is directed into the screen cage.

18. A trommel screening apparatus for screening material comprising:

a) a support frame;

b) a trommel screen cage for receiving material to be screened, the screen cage having an open front, a closed back, and outer peripheral framework, including a rail and a screen panel attached to the peripheral framework;

c) a carriage hinged to the support frame and supporting the screen cage whereby the open front of the trommel screen cage is movable up and down with respect to the support frame;

d) a plurality of trunnions rotatably mounted to the carriage, the trommel screen cage further being positioned within the carriage with the rail engaging the trunnions whereby the trommel screen cage is rotatable;

e) a drive means attached to the carriage and engaged with the trommel screen cage for rotating the screen cage whereby the material in the screen cage is tumbled and screened material falls downwardly through and below the screen cage; and f) a hydraulic cylinder mounted between the carriage and the support frame to variably tilt the carriage and the trommel screen cage with respect to the support frame.

19. The apparatus of claim 18, wherein the support frame has wheels to transport the apparatus.

20. The apparatus of claim 18, further comprising a conveyor mounted on the support frame extending under the screen cage and rearwardly of the support frame for receiving screened material from the screen cage and conveying the material out from under and away from the support frame.

21. The apparatus of claim 20 further comprising remote control means to control the variable tilting of the carriage and trommel screen cage, and the rotation of the trommel screen cage remotely from the apparatus.

* * * * *